United States Patent [19]

Moot

[11] 4,231,744

[45] Nov. 4, 1980

[54] PROCESS FOR DYEING CLOSELY CONSTRUCTED NON-TUFTED TEXTILE MATERIALS AND PRODUCTS PRODUCED THEREBY

[75] Inventor: Lorence M. Moot, Spartanburg, S.C.

[73] Assignee: Milliken Research Corporation, Spartanburg, S.C.

[21] Appl. No.: 915,822

[22] Filed: Jun. 15, 1978

[51] Int. Cl.[2] ..... D06P 5/00

[52] U.S. Cl. ..... 8/495; 8/115.6; 8/615

[58] Field of Search ..... 8/17, 18 R, 94 A, 115.6

[56] References Cited

U.S. PATENT DOCUMENTS

| | | | |
|---|---|---|---|
| 2,642,416 | 6/1953 | Ahlbrecht et al. | 260/23.7 M |
| 2,803,615 | 8/1957 | Ahlbrecht et al. | 260/29.7 H |
| 3,378,609 | 4/1968 | Fasick et al. | 260/29.6 F |
| 3,493,614 | 2/1970 | Pacini | 8/4 |
| 3,503,915 | 3/1970 | Peterson | 260/29.6 F |
| 3,651,120 | 3/1972 | Anello et al. | 8/89 |
| 3,992,145 | 11/1976 | Coraor | 8/94 A |
| 4,065,259 | 12/1977 | Jackson | 8/166 |

OTHER PUBLICATIONS

Morenau, J. P. and Drake, G. L., American Dyestuff Reporter, 1969, 58, (No. 3), pp. 21–26.

Mares and Oxenrider, Textile Research Journal, Aug. 1977, pp. 557–560.

Moreau and Drake, American Dyestuff Reporter, 1969, 58, (No. 4), pp. 21–26.

*Primary Examiner*—A. Lionel Clingman

*Attorney, Agent, or Firm*—H. William Petry; Terry T. Moyer

[57] ABSTRACT

An improved process for dyeing closely constructed non-tufted textile materials is provided wherein an effective minor amount of a substantially oil and water repellent fluoropolymer is applied to the textile material. The substantially oil and water repellent fluoropolymer employed can be represented schematically as polymeric backbone
|
linking moiety
|
fluorinated tail.

The textile material can be, if desired, scoured with an aqueous surfactant solution to remove any residual dirt, oil or processing aids present on the textile material and thereafter scoured with an aqueous acidic solution to provide the textile materialwith an acidic pH prior to application of the fluoropolymer. Further, the back portion of the textile material can be backcoated with an elastomer composition. Once the textile material has been treated using any of the above processing steps, in combination with the application of the fluoropolymer, the resulting polymer-modified textile material is thoroughly dried and cured prior to dyeing. The application of the fluoropolymer to the textile material and its effect on the subsequent dyeing of the polymer modified textile material can further be enhanced by the use of a minor effective amount of a fluorosurfactant in combination with the fluoropolymer. The dyed products resulting from the process of the invention generally have reduced frosting and improved pattern definition and color yield.

12 Claims, 5 Drawing Figures

PROCESS FOR DYEING CLOSELY CONSTRUCTED NON-TUFTED TEXTILE MATERIALS AND PRODUCTS PRODUCED THEREBY

This invention relates to an improved process for dyeing closely constructed non-tufted textile materials. In one aspect the invention relates to the application of a minor effective amount of a substantially oil and water repellent fluoropolymer to a closely constructed non-tufted textile material prior to dyeing of same. In yet another aspect the invention relates to a fluoropolymer modified textile material having improved dyeing characteristics.

Textile materials have heretofore been colored with natural and synthetic dyes by numerous processes, such as transfer printing, jet dyeing and the like. Further, such processes have been employed to print a color decoration on the surface or surfaces of the material in definite repeated forms and color to produce a pattern. While such prior art dyeing processes have met with success, problems have nevertheless been encountered in the pattern dyeing of certain types of textile substrates. For instance, when pattern dyeing textile materials, such as closely constructed non-tufted textile materials, problems have often been encountered in that the repeating units of a pattern are not sharply defined, frosting occurs on the dyed material, and the color is not uniform throughout the dyed textile material.

Numerous attempts have been made to solve the above-mentioned problems without much success. Therefore, a need has existed for new and improved processes for the dyeing of closely constructed non-tufted textile materials which will substantially reduce or eliminate frosting of a dyed textile material, and at the same time, improve the clarity and color definition of the dyed textile material, especially pattern dyed textile materials.

Therefore, an object of the present invention is to provide an improved process for the dyeing of closely constructed non-tufted textile materials. Another object of the present invention is to provide an improved process for the pattern dyeing of closely constructed non-tufted textile materials which does not suffer from the before-mentioned disadvantages of the prior art. These and other objects, advantages and features of the present invention will become apparent to those skilled in the art from a reading of the following detailed disclosure.

According to the present invention, we have now discovered an improved process for the dyeing of closely constructed non-tufted textile materials wherein frosting of the dyed textile material is substantially reduced or eliminated and wherein clarity and color yield of the dyed product is greatly enhanced. Broadly described, the invention resides in a process for improving the dyeing characteristics of closely constructed non-tufted textile materials which comprises applying an effective minor amount of a substantially oil and water repellant fluoropolymer to the textile substrate to substantially cover and form a discrete, discontinuous polymer coating on the fibers of such textile material, drying and curing the resulting fluoropolymer modified textile material, and thereafter dyeing the dried, cured fluoropolymer modified material.

In a more specific embodiment the fabric is treated with an aqueous acid solution to lower the pH of the textile material to a pH of less than about 7, generally from about 4.0 to about 6.5, prior to applying the substantially oil and water repellant fluoropolymer to the textile material. Further, the back surface of the textile material can be coated with an elastomer composition, e.g., backcoated, either before or after the scouring of the textile material or the application of the fluoropolymer to same. In yet another embodiment an effective minor amount of a fluorosurfactant is incorporated with the fluoropolymer constituent for application to the closely constructed non-tufted textile material.

A drawing accompanies and is made a part of this disclosure.

In the drawing

Figure 1:
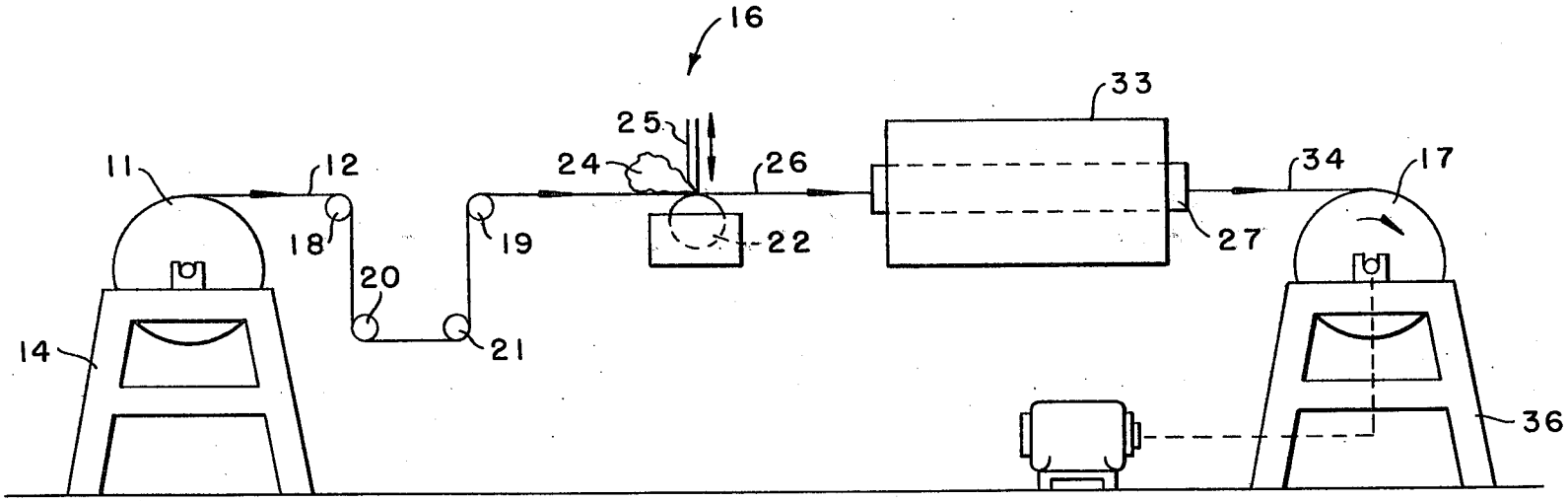
FIG. 1 is a schematic representation of an apparatus for backcoating a closely constructed non-tufted textile material.

Textile materials which can be modified with the substantially oil and water repellant fluoropolymers to enhance their dyeability as set forth herein are characterized as closely constructed non-tufted textile materials. Generally such textile materials are classified as having a weight of from about 4 oz/yd$^2$ to about 20 oz/yd$^2$ and are generally known as drapery fabrics, upholstery fabric, including automotive upholstery fabrics and the like. Such textile materials can be formed of natural or synthetic fibers, such as polyester, nylon, wool and acrylic, including textile materials containing mixtures of such natural and synthetic fibers.

The term "closely constructed non-tufted textile materials" as used herein to be understood to mean textile materials having the fibers therein closely located to one another so that the interstices between fibers are not readily visible to the naked eye. Further, the word non-tufted is to include, but not limit, textile materials which do not contain fluffy tufts of soft-twist, multiple yarns. When the fluoropolymer modified closely constructed non-tufted textile material is to be dyed using jet-dyeing techniques, the textile material is further characterized as having a weight of at least about 4 ounces per square yard.

Once the desired textile material has been selected and it is determined beneficial to improve the dyeing characteristics of such material in accordance with the process of the present invention, an effective minor amount of a substantially oil and water repellant fluoropolymer is applied to the textile material to substantially cover the fibers of such material in at least the stratum of fibers on and near the face of the textile material (e.g. the surface of the material which is finished more completely than the other surface) thereby forming a discrete, discontinuous polymer coating on such fibers. Especially desirable results can be obtained when the amount of fluoropolymer employed is sufficient to provide the desired discrete, discontinuous polymer coating on substantially all of the fibers of the textile material. Thus, the amount of fluoropolymer employed can vary widely depending upon whether only those fibers or stratum of fibers on and near the face of the fabric are to be covered with the fluoropolymer, whether substantially all of the fibers in the textile material are to be covered, or whether a non-fluorine containing fluoropolymer extender is used in combination with the fluoropolymer. Generally such can be achieved and a discrete, discontinuous fluoropolymer coating formed on either the fibers within or on the stratum of fibers in or near the face of the fabric, or on substantially all of the fibers of the textile material, by applying to the textile material from about 0.20 to about 2.5 weight percent of the fluoropolymer, based on the weight of the textile material. However, when from about 0.1 to about 7.5 weight percent, based on the weight of the textile material, of a fluoropolymer extender is used in combination with the fluoropolymer, the amount of fluoropolymer applied to the textile material can be reduced to an amount of from about 0.10 to about 1.0 weight percent without substantially affecting the improved dyeing characteristics of the fluoropolymer modified textile material.

After the desired amount of fluoropolymer has been applied to the textile material, the resulting fluoropolymer modified textile material is heated to a temperature effective to dry and cure same. The temperature required to dry and cure the fluoropolymer modified textile material, as well as the period of time required for same can vary widely. Generally however, such drying and curing of the polymer modified textile material can readily be achieved by heating the polymer modified textile material to a temperature of from about 275° F. to about 375° F. for a period of time of from about 30 seconds to about 10 minutes.

Once the fluoropolymer modified textile material has been dried and cured, it can be dyed or subjected to other processing steps as will be discussed hereinafter.

Any suitable substantially oil and water resistant fluoropolymer can be employed in the practice of the present invention. However, it is believed that in order for these fluoropolymers to be suitable, several conditions must be satisfied. For instance, the fluorinated chain of the fluoropolymer should be capable of being evenly distributed on the fibers of the textile material with proper orientation of the perfluoro group to provide an essentially fluorinated surface on discrete portions of such fibers. Secondly, the fluoropolymer should have a terminal —$CF_3$ group so as to provide a very low energy surface.

The polymeric backbone portion above illustrated is the polymerization product of ethylenically unsaturated monomers, such as ethylene, acrylates, mixtures thereof, and the like. The linking moiety of the fluorine containing polymer can generally be any suitable organic group capable of linking the fluorinated tail of the polymer to the polymeric backbone. Further the linking moiety may carry a cation which provides a cationic charge to the fluorine containing polymers. Typical of the linking moiety in the fluorine containing polymers used in the practice of the present invention are

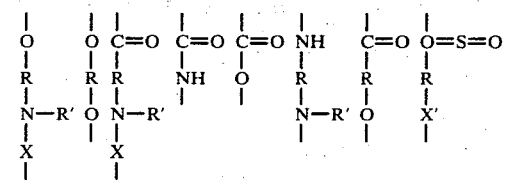

or cationic charged linking moieties such as

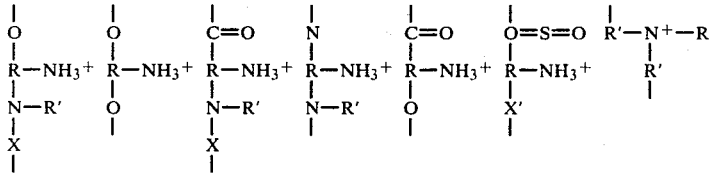

and the like. In each of the above depicted linking moieties R is an alkylene moiety containing from about 1 to about 2 carbon atoms, R′ is H or an alkyl moiety containing from 1 to about 6 carbon atoms, X is S or $SO_2$, and X′ is S, $SO_2$, or O.

The fluorinated tail portion of the before depicted fluoropolymer is

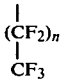

wherein n is an integer of from about 4 to about 12.

Therefore, the substantially oil and water resistant fluoropolymers useful in the practice of the present invention can be characterized as a fluorinated polymer containing appendant perfluorocarbon tails in the form of terminal portions or side chains in the polymer. The perfluorocarbon tail is believed to be a monovalent perfluorocarbon radical of at least 4 and not more than about 12 carbon atoms in which all of the substituents are fluorine or a completely or highly fluorinated saturated organic radical. The perfluorocarbon tail can be an aliphatic radical, either acrylic or alicyclic and may further contain oxygen, nitrogen, sulfur, or other atoms in the chain. The perfluorocarbon radical may be straight chain, branched, or cyclic. The fluorine of the perfluorocarbon tail of the fluorine-containing polymer should represent at least about 20 percent, more likely at least about 30 percent, by weight of the polymer. The backbone of the polymer will normally contain methylene groups and, in addition, side chains may also contain such methylene groups. These methylene groups in the backbone and side chains of the polymer should be less than about 30 percent by weight of the polymer. Also, the side chains which contain methylene groups should preferably be terminated by a perfluorocarbon radical as above.

The term "polymer" as used herein is to be understood to include adducts of two or more of the same or different monomeric units, such as dimers and trimers. Usually, the fluoropolymer is linear and may be a homopolymer of a fluorine monomer or a copolymer of a fluorinated monomer and a fluorine free organic monomer. Such copolymers are generally random copolymers. The fluoropolymers which are useful in the practice of the present invention can be prepared from fluorinated organic precursors having the perfluorocarbon tail or radical at one end of the molecule and a reactive functional group at the other end of the molecule. Such fluorinated organic precursors can be represented by the formula $R_fQ(CH_2)_nX$ in which $R_f$ is the perfluorocarbon radical containing at least about 4 carbon atoms, Q is a divalent linking radical such as a sulfonoamido radical, carbonamido radical, mono-substituted nitrogen, an ester radical, an unsubstituted alkylene radical, a halogen substituted alkylene radical, an arylene radical, and the like, n is an integer of from 0 to about 14 and x is a reactive functional group such as carbinol group, carboxyl group, an amine group, a mercaptan group, or halogen, such as chlorine, bromine or iodine.

The fluorinated precursor compound described above may then be reacted with another compound having functional groups reactable therewith to form the adduct or polymer. The fluorine-containing precursor compound may alternately be reacted with an ethylenically unsaturated organic compound containing a functional group reactable therewith to produce a vinyl monomer, such as an acrylate or methacrylate, which acrylate or methacrylate is then polymerized by vinyl addition to produce the ultimate polymer. Processes for producing such fluoropolymers are known in the art, for example U.S. Pat. No. 2,642,416, and U.S. Pat. No. 2,803,615.

Copolymers may also be prepared by co-reacting the above fluorinated monomers with various non-fluorinated ethylenically unsaturated organic monomers, including ethylene, vinyl acetate, acrylonitrile, acrylamide, styrene, acrylic and methacrylic acid and alkyl esters thereof. Numerous other methods of producing such fluoropolymers are known in the art. Fluoropolymers or liquid admixtures containing same which are especially useful in the practice of the subject invention are commercially available from Minnesota Mining and Manufacturing Company, St. Paul, Minn., under the trademarks "Scotchgard"[R] 214 and 234 from E. I. du Pont de Nemours and Co., Wilmington, Del. under the trademarks "Zepel" [R] RN and RS.

The term "fluoropolymer extender" as used herein is to be understood to mean non-fluorine containing surfactants which improve the wetting characteristics of the textile material and thereby enhance the application of the fluoropolymer to the textile material. Any suitable surfactant which is compatible with the fluoropolymer and the textile material and which will improve the wetting characteristics of the textile material can be employed. Such surfactants can be cationic, anionic, non-ionic, or amphoteric in nature. Especially desirable results can be obtained when the surfactants are cationic or non-ionic in character.

Typical examples of fluoropolymer extenders meeting the above criteria are $C_3$–$C_{15}$ alcohols, including linear, non-linear, saturated and unsaturated, such as isopropanol, 1-dodecanol, 2-ethylhexanol, allyl alcohol; cationic surfactants, such as cationic polyethylene, 1-dodecyltrimethyl ammonium chloride; fatty alcohols such as 1-octadecanol, 1-hexadecanol and the like; anionic surfactants, such as sodium lauryl sulfate, dodecyl sulfosuccinate, dodecyloxy poly (oxyethyl) sulfosuccinate, alkyl phosphates and the like; non-ionic surfactants; amphoteric surfactants; ethylene copolymers; fatty glycerides, such as glycerol trioleate, caster oil and the like; ethoxylates, such as ethoxylated castor oil and the like.

While it has been found that by application of a fluoropolymer to a closely constructed non-tufted textile material, either alone or in combination with a fluoropolymer extender as set forth hereinabove, and the subsequent curing of the resulting fluoropolymer modified textile material substantially improves the dyeability of such textile materials in that the resulting dyed products have reduced frosting and improved pattern definition and color value, it has further been found that an additional improvement can be obtained if a minor effective amount of a fluorosurfactant is admixed with the fluoropolymer prior to the application of the fluoropolymer to the textile material. The improvement derived from the use of the fluorosurfactant, in combination with the fluoropolymer, cannot only be seen in the pattern definition and color value of the resulting dyed products but also by the improved penetration of the dye into the slub yarns of the textile material. In addition, the use of a minor effective amount of the fluorosurfactant may allow one to reduce the amount of fluoropolymer required to be applied to the textile material to obtain the beneficial results. While the amount of the fluorosurfactant employed in combination with the fluoropolymer can vary widely, generally desirable results can be obtained when the amount of fluorosurfactant applied to the textile material is from about 0.001 to 0.01 weight percent and the amount of fluoropolymer employed is from about 0.20 to about 2.5 weight percent, each of said amounts being based on the weight of the textile material.

The term "fluorosurfactant" as used herein is to be understood to mean a surface active agent which is capable of reducing the surface energy of a liquid at relative low concentrations and wherein the hydrophilic group of the surface active agent contains a solubilizing group and the hydrophobic tails of the surface active agent contains and is terminated with $R_f$, such representing a stable fluorocarbon moiety.

Fluorosurfactants useful in the practice of the present invention are non-ionic or anionic fluorosurfactants and are commercially available under the trademark "Fluorad" [R] brand fluoro chain surfactants manufactured and sold by Minnesota Mining and Manufacturing Company, St. Paul, Minn. and "Zonyl" [R] brand fluorosurfactants manufactured and sold by E. I. du Pont de Nemours and Co., Wilmington, Del. Typical of such fluorosurfactants such as ammonium perfluoroalkyl sulfonates, potassium perfluoroalkyl sulfonates, potassium fluorinated alkyl carboxylates, ammonium perfluoro alkyl carboxylates and the like and the non-ionic fluorosurfactants such as fluorinated alkyl polyoxyethylene ethanols, fluorinated alkyl esters, and the like. Each of the above fluorosurfactants contain a fluorocarbon chain, such $F_3CCF_2CF_2$—in the fluorocarbon chain. This fluorocarbon portion of the fluorosurfactant molecule gives such surfactants an extreme tendency to orient at interfaces.

The fluoropolymer can, as set forth above, be applied to the textile material either by itself or in combination with fluoropolymer extenders or fluorosurfactants. Any suitable means can be employed to apply the fluoropolymer to the textile materials. However, desirable results can be obtained when the fluoropolymer is applied as an aqueous admixture using any suitable application technique such as padding, spraying, and the like. Especially desirable results can be obtained when the aqueous admixture is applied by a padding technique because the fluoropolymer is more uniformly applied to the textile material.

In preparing the aqueous admixture containing the desired amount of fluoropolymer, e.g. from about 0.20 to about 2.5 weight percent, the fluoropolymer which is generally a solid dispersed in a liquid emulsion is admixed with a predetermined amount of water to provide the desired concentration of the fluoropolymer in the aqueous admixture. One particular method of preparing the aqueous fluoropolymer admixture is to admix an effective amount of FC-234 "Scotchgard" into a predetermined amount of water to provide an aqueous admixture containing from about 0.20 to about 2.5 weight percent of the fluoropolymer. FC-234 "Scotchgard" brand velvet protector is a commercially available fluorochemical emulsion designed for use on home furnishings, especially cellulosic pile upholstery fabrics for imparting an oil and water repellency, as well as abrasion resistance, finish to the fabric. Such a composition contains as a general formulation the following:

30% solid—fluoropolymer
35% methyl isobutyl ketone
8% glycol
35% water.

The above-described fluoropolymer emulsion is stated to have a pH of from 2.5–3.5, a cationic charge and a density of 1.05 kg/liter.

Thus, since the above-described commercially available fluoropolymer emulsion contains 30 percent of the fluoropolymer, sufficient water is added to the emulsion to provide a resulting liquid admixture containing from about 0.10 to about 2.5 percent of the polymer.

Another especially suitable commercially available fluoropolymer emulsion which can be employed to form the aqueous fluoropolymer admixture for use in the process of the present invention is FC-214 "Scotchgard" brand Fabric Protector, a fluorochemical emulsion designed for use on home furnishing fabrics. Such composition contains as a general formulation the following:

30% solids (fluoropolymer)
11% methyl isobutyl ketone
6% ethylene glycol
53% water.

The above-described fluoropolymer emulsion is stated to have a pH of from 2.0 to 3.0, a cationic charge and a density of 1.125 kg/liter.

The above-described fluoropolymer emulsions, upon dilution with water to contain the specified amounts of about 0.10 to about 2.5 weight percent of the fluoropolymer will thus contain from about 0.03 to about 2.9 weight percent of an organic carrier, such as the methyl isobutyl ketone or methyl ethyl ketone and from about 0.7 weight percent of a stabilizer, such as glycol or ethylene glycol.

Other suitable commercially available fluoropolymers and emulsion containing same which can be used to form the aqueous fluorocarbon admixtures containing from about 10 to about 30 weight percent of the fluorocarbon constituent are those fluorocarbon emulsion manufactured and sold by E. I. du Pont de Nemours and Co., as Zepel [R] brand fluoropolymer emulsions.

Any other suitable fluoropolymer, or aqueous emulsion of same, which is either cationically charged by the use of a cationic emulsifier or wherein the fluoropolymer itself is cationically charged can be employed. However, it should be noted that if one is to obtain the desired result, the concentration of the fluoropolymer in the resulting aqueous admixture should be an amount sufficient to provide at least about 0.20 weight percent of the fluoropolymer on the textile material; or, wherein used in combination with a fluoropolymer extender or a fluorosurfactant at least about 0.10 weight percent or 0.20 weight percent, respectively.

The amount of the fluorocarbon required to be present in the pad bath will also vary depending upon the wet pickup characteristics of the particular textile material being treated. For example, the closely constructed non-tufted textile materials which can be treated in accordance with the process of the present invention will generally have a wet pickup of from about 50 to about 150 percent, more desirably from about 75 to about 125 percent.

While we have found that the dyeing characteristics of a closely constructed non-tufted textile can be greatly improved by the application of the fluoropolymer as specified above, either alone or in combination with a fluoropolymer extender or a fluorosurfactant, we have further found that an additional improvement in the dyeing characteristics of the textile material can be achieved by scouring the textile material, either prior to or subsequent to backcoating, but prior to application of the fluoropolymer, to remove residual processing aids which may be present on the fabric, as well as dirt and/or oily materials, and to adjust the pH of the textile material to a pH of less than 7, more desirably of from about 4.0 to about 6.5. By scouring the textile material and adjusting the pH of the textile material to less than about 7, improved results can be obtained in the subsequent application of the fluoropolymer, as well as the dyeing of the resulting fluoropolymer modified textile material.

The scouring of the textile material to remove any residual textile processing aids, dirt, oil residues and the like can be readily accomplished by passing the textile material through an aqueous detergent containing solution heated to a temperature of from about 100° F. to about 200° F. and thereafter thoroughly rinsing the scoured textile material with water to insure substantially complete removal of and residual detergent.

Desirable, the rinse water is also heated to a temperature of from about 100° F. to about 200° F. The amount of the detergent constituent employed in the aqueous detergent containing solution can vary widely as can the type of detergent. Generally, however, desirable results can be obtained when the amount of detergent constituent employed is from about 0.25 to about 1.0 weight percent, based on the total weight of the detergent solution. Any suitable detergent can be employed provided the detergent does not react with, or cause other deleterious effects, the textile material being scoured with same. Typical examples of suitable detergents which can be employed in the detergent scouring of closely constructed non-tufted textile materials in accordance with the subject invention are lauryl alcohol ethoxylate, alkyl ether sulfates and sulfonates.

Once the textile material has been scoured with the detergent solution and thoroughly rinsed as set forth above, the detergent scoured textile material is passed through an aqueous acidic solution maintained at a temperature of from about 100° F. to about 200° F. to adjust the pH of the textile material to a pH of less than about 7, generally to a pH of from about 4 to about 6.5. The amount of said acid constituent employed in the aqueous acid solution can vary widely, such depending to a large extent upon the type of the acid constituent. As currently envisioned, the passing of the detergent scoured textile material through the aqueous acidic solution would be considered as the final step of the scouring of the textile material. However, it should be noted that one could, if the textile material was substantially free of textile processing aids, dirt, oil residue and the like, eliminate the detergent scouring step of the scouring process and thus the scouring of the textile material would consist only of passing the textile material through an aqueous acidic solution to adjust the pH of the textile material to the desired pH prior to application of the fluoropolymer to the textile material. It should further be noted that the scoured textile material can be dried prior to application of the fluoropolymer thereto; or, the fluoropolymer can be applied to the wet, scoured textile material. However, we prefer to dry the scoured textile material prior to application of the fluoropolymer thereto.

Any suitable acid can be employed as the acidic constituent of the acidic wash solution provided such acid does not have deleterious effects on the textile material being washed, or form a residue which interferes with the application of fluoropolymer or the dyeing of the fluoropolymer modified textile material during subsequent processing steps. Illustrative of acids which can be employed are acetic acid, formic acid, butyric acid, citric acid, oxalic acid, and the like.

Once the textile fabric has been washed or scoured with the detergent, and passed through the acid bath, it can be subjected to the next processing step, e.g. either backcoating of the textile material or application of the fluoropolymer in its wet state or, more desirably, dried by contacting the wet textile material with a heat source to substantially dry same prior to the application of either the backcoating resin or the fluoropolymer.

The application of the backcoating composition to the fabric may be accomplished by any suitable means known in the art. Typical of such are the knife-over-roll coater. In such a process two or three coating knife arrangements may be used in tandem or sequentially to deposit and smooth the coating while it is still wet and fluid.

Another suitable method for backcoating the textile material is the use of reverse-rotating coating rolls. When employing such equipment, the amount of coating to be applied is precisely metered prior to application to the fabric by a wiping action. Use of precision-ground and mounted coating rolls makes possible control of coating weight to within about 0.002 inch thickness.

The backcoating of the fabric can also be carried out using an engraved-roll or rotogravure coating unit. In employing such the coating compound is not metered prior to application to the fabric. The total thickness of coating plus fabric is metered through the gap formed by the reverse smoothing roll and the backing roll. Any variation in thickness of the fabric is reflected in corresponding thicker or thinner coating at such areas.

In addition to the wet coating processes, typical ones which have been set forth above, one would employ any one of numerous dry (e.g. 100% solids) coating processes. Typical dry coating processes which are well known in the art are the hot-melt coating process and the like.

While any of the above-similar coating processes can be employed for the application of the backcoating composition to the back of the fabric, especially desirable results have been obtained when using a wet coating process, such as the knife-over-roll coating process.

Any suitable elastomer coating composition may be employed as the backcoating composition, such as styrene-butadiene rubber, acrylic ester latex compositions and the like.

The latex backcoating generally improves the dimensional stability and raveling resistance of textile materials to be used for automotive upholstery, draperies and the like. Further, the latex backcoating improves the hand of the material by providing the material with body and weight. In addition, backcoating of a textile material helps prevent distortion of patterns on plush and flat textile materials.

The amount of latex employed to backcoat the closely constructed non-tuft textile materials for processing in accordance with the present invention can vary widely. Generally, however, such coatings will be very light weight coatings, ranging from about 2 to about 4 ounces of latex per square yard of textile material. The latex coating compositions employed to backcoat textile materials usually contain from about 5 to about 50 weight percent solids (e.g. solids being the latex particles) in order to assure a uniform coating of the textile material, but such latex coating compositions are of a sufficiently high viscosity (e.g. from about 2,000 cP to about 150,000 cP) to avoid striking through the textile material, fillers (e.g. clays or whitings) are used, normally about 50 to about 300 parts of filler per 100 parts of latex to avoid stiffening of the textile material.

Typical of such latex coating compositions are aqueous emulsion having the following formulations:

ACRYLIC ESTER LATEX COMPOSITION

| Constituent | % By Weight |
|---|---|
| Acrylic ester polymer | 65.6 |
| Filler (clay or whiting) | 13.1 |
| Thickeners | 2.8 |
| Ammonia (28%) | 0.8 |
| Dispersing Agent | 0.2 |
| Tetra Sodium Pyro Phosphate | 0.1 |
| $TiO_2$ | 1.8 |
| Surfactant | 1.0 |
| Melamine Resin | 0.2 |
| Di-iso Dectyl Phthalate | 1.2 |
| Water | 13.1 |

STYRENE-BUTALIENE RUBBER

| Constituent | % By Weight |
|---|---|
| Polymer (latex) | 24.61 |
| Ammonium Caseinate | 0.51 |
| Zinc Oxide | 1.22 |
| Sulfur | 0.50 |
| Styrenated Phenol | 0.25 |
| Zinc Salt of Mercaptobenzothiazole | 0.50 |
| No. 10 Whiting | 12.31 |
| Methylcellulose (thickener) | 0.10 |
| Water | 60 |

Numerous other latex coating compositions which are well known in the coating art can be used to backcoat the textile material.

After the desired amount of the latex coating composition has been applied to the textile material, the resulting backcoated textile material is heated to a temperature effective to substantially cure the latex coating composition and provide a substantially dry backcoated textile material. The temperature to which the resulting backcoated textile material is heated, as well as the period of time of such heating required to cure the latex coating composition and dry the resulting textile material can vary widely, such depending to a large extent on the amount of latex coating composition applied to the textile material as well as the general type of such composition. Generally, however, we have found that such curing of the latex coating composition and the drying of the resulting textile material can readily be achieved by heating the backcoated textile material to a temperature of from about 275° F. to about 375° F. for a period of time of from about 30 seconds to about 10 minutes.

Once the textile material has been modified by the application of the fluoropolymer, and when desired backcoated and scoured as hereinbefore stated, the fluoropolymer modified textile material may be sheared to remove uneven hairs from the face of such material and thereby provide a more uniform surface. Any suitable shearing process well known in the textile art can be employed.

Thereafter, the fluoropolymer treated textile material can be dyed by any suitable method such as jet dyeing, transfer printing, screen printing and the like, especially where a desired printed color decoration on the surface of the textile material is desired or when definite repeated forms and colors are employed to form a pattern. Especially desirable results can be obtained when the fluoropolymer modified closely constructed non-tufted textile materials are dyed using a jet dyeing process and apparatus such as disclosed in U.S. Pat. Nos. 4,084,615; 4,034,584; 3,985,006; 4,059,880; 3,937,045; 3,894,413; 3,942,342; 3,939,675; 3,892,109; 3,942,343; 4,033,154; 3,969,779; 4,019,352; and pending U.S. patent application U.S. Ser. No. 686,900, filed May 17, 1976, entitled "Printing of Pattern Designs with Computer Controlled Pattern Dyeing Device;" and U.S. patent application U.S. Ser. No. 806,783, filed June 15, 1977, entitled "Apparatus for the Application of Liquids to Moving Materials," each of said patents and patent applications being hereby expressly incorporated by reference.

In a jet dyeing process and apparatus such as set forth in U.S. Pat. No. 3,969,779, a jet pattern dyeing machine is provided with a plurality of gun bars each containing plural dye jets extending across the width of an endless conveyor. The gun bars are spaced along the conveyor, and the fluoropolymer modified closely constructed non-tufted textile material is carried by the conveyor past the gun bars where dyes are applied to form a pattern thereon. The application of the dye from the individual dye jets in the gun bars is controlled by suitable adapted pattern control means such as mentioned in U.S. Pat. Nos. 3,969,779 and 4,033,154. The patterned dyed fluoropolymer modified textile material is then passed through a steamer wherein the dyed fluoropolymer modified textile material is subjected to a steam atmosphere to fix the dyes thereon. The dyed fluoropolymer modified textile material leaving the steam chamber is conveyed through a water washer to remove excess unfixed dye therefrom. The washed textile material is then passed through a hot air dryer to a delivery and takeup means.

While the application of the dye to the fluoropolymer modified textile material has been set forth by a jet printing apparatus, it is to be understood that any suitable means for applying dye in the form of a pattern to a textile substrate can be employed. For example, the dye can be applied to the fluoropolymer modified textile material employing transfer printing technique, e.g. a dry printing technique. When employing a transfer printer, especially desirable results can be obtained if the fluoropolymer modified textile material is heat set, brushed, printed, heat set again to securely affix the dye, and thereafter brushed a second time.

In order to more fully depict the process for improving the dyeability of closely constructed non-tufted textile materials in accordance with the invention reference will now be made to the drawing. The drawing represents schematic diagrams of sequential processing steps. However, it is to be understood that one could conduct such sequential processing steps as a continuous process.

Referring now to the drawing and particularly FIG. 1, a supply roll 11 of closely constructed non-tufted textile material 12 is mounted on a suitable support 14. The advancement of material 12 through the backcoating apparatus 16 is indicated by the solid line in the direction of the arrows. The textile material 12 is continuously withdrawn from roll 11 by power driven take up roll 17 and passed over a plurality of support rollers such as 18 and 19, idler rollers 20 and 21 and brought into contact with backcoating apparatus 16. Backcoating apparatus 16 is depicted as having a support roller 22, a supply source 24 for supply to the elastomer or latex backcoating composition to the back of textile material 12, and a doctor knife 25. Doctor knife 25 is adjustably positioned in a spaced relationship with support roller 22 and textile material 12 to remove excess latex backcoating composition from textile material 12 and also to insure a substantially uniform coating of the latex backcoating composition to the back of the material.

After the desired amount of latex backcoating has been applied to the back of textile material 12, the backcoated textile material 26 is advanced to tenter frame 27 where the material is framed to a desired width. Tenter frame 27 extends through curing oven 33 so as to maintain the textile material at a desired width during the curing of the latex backcoat. Backcoated textile material 26 is passed through curing oven 33 at a sufficient rate to insure that the latex coating composition is completely dried and cured. Generally the latex coating composition can be dried and cured if the oven is maintained at a temperature of from about 350° F. to about 375° F. and the coated textile material is maintained in the oven for a period of time of from about 1.5 minutes to about 2 minutes. The cured latex coated textile material 34 is then advanced to take up roll 17 which is mounted on a suitable support 36.

Figure 2:
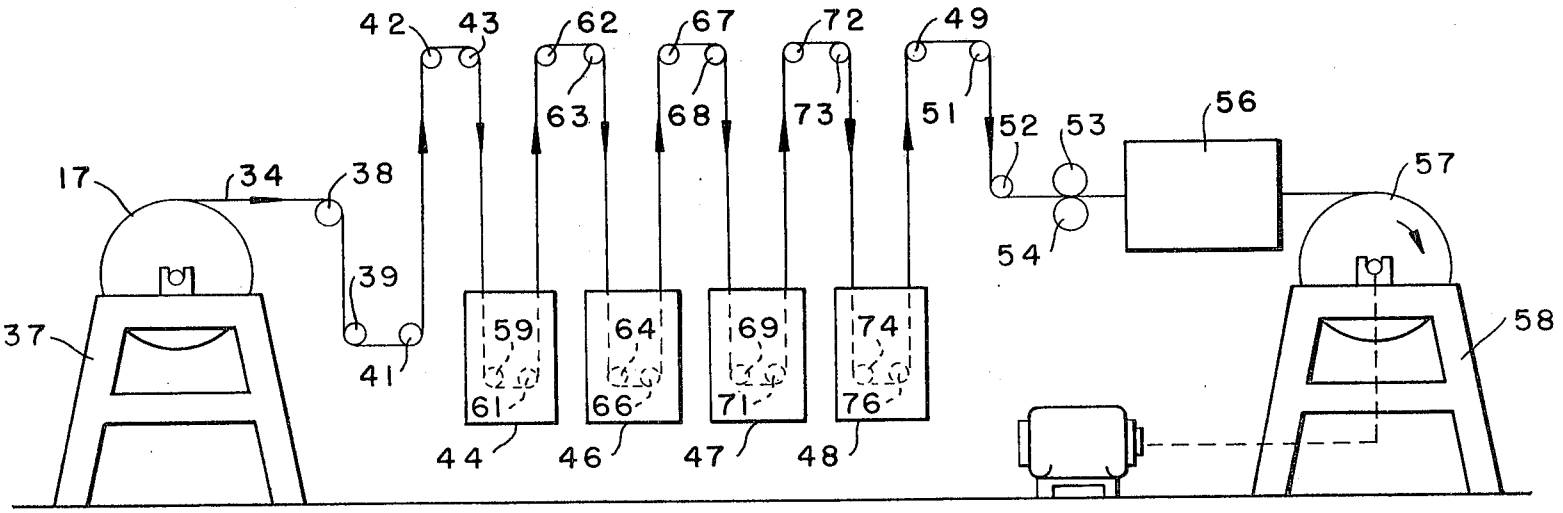
FIG. 2 is a schematic representation of an apparatus for scouring the textile material and to adjust the pH of such textile material.

Referring now to FIG. 2, an apparatus for scouring the cured latex coated textile material produced in FIG. 1 is depicted. Supply roll 17' which was take up roll 17 of FIG. 1, contains the cured latex coated material 34. Supply roll 17' is mounted on a suitable support 37 and the advancement of material 34 through the scouring apparatus is indicated by the solid line in the direction of the arrows. Material 34 is withdrawn from roll 17 and advanced over a plurality of rollers such as rollers 38, 39, 41, 42, and 43, through a plurality of scouring vessels such as 44, 46, 47 and 48, over a second plurality of rollers such as 49, 51, and 52, through nip rollers 53 and 54, through drier means 56 and then to take up roller 57 which is mounted on a suitable support 58. Take up roller 57 may be a power driven take up roller to insure proper advancement of material 34 through the scouring vessels and the drying means.

In the scouring of textile material 34 using the plurality of scouring vessels as depicted, one can remove residual textile processing aids, dirt, and oily deposits in the first of the series of scouring vessels and adjust the pH of textile material 34 in the last of the scouring vessels. To be more explicit, scouring vessel 44 contains an aqueous detergent solution as hereinbefore set forth, vessel 48 contains an aqueous acidic solution as has likewise hereinbefore been described. Each of the aqueous mediums in the scouring vessels is maintained at a temperature of from about 100° F. to about 200° F., more typically about 120° F. Textile material 34 is maintained in a substantially taunt position as it passes through scouring vessels 44, 46, 47 and 48 by a plurality of support rollers such as rollers 59, 61, 62, 63, 64, 66, 67, 68, 69, 71, 72, 73, 74, and 76. Excess aqueous acidic solution used to adjust the pH of the textile material is removed by passing the wet material through nip rollers 53 and 54 prior to passing the acid treated material into drier means 56 in which the material is heated to a temperature sufficient to substantially dry the textile material. The desired pH adjusted textile material is then advanced to take up roll 57 and from there can be stored for subsequent use in the application of the fluoropolymer and use the process depicted in FIG. 3, or moved directly to such process.

Figure 3:
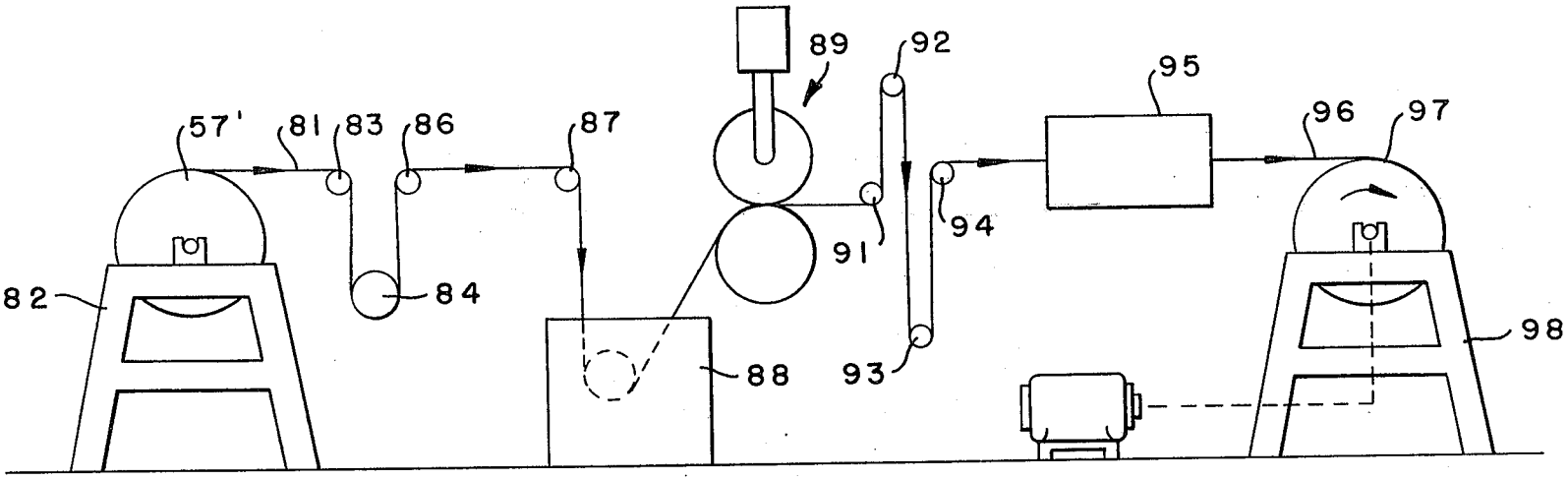
FIG. 3 is a schematic representation of an apparatus which may be employed to apply the fluoropolymer to the scoured textile material.

Referring now to FIG. 3, a process and apparatus suitable for applying the fluoropolymer to the pH adjusted, backcoated textile material is set forth. Supply roll 57', which was take up roll 57 of FIG. 2, contains pH adjusted, dried, backcoated textile material 81. Supply roll 57 is mounted on a suitable support 82 and the advancement of material 81 through the apparatus for applying the fluoropolymer or fluoropolymer and fluoropolymer extender or fluorosurfactant is indicated by the solid line in the direction of the arrows. Textile material 81 is advanced over a plurality of support rollers 83, 84, 86 and 87 and into pad bath means 88. Textile material 81 is maintained in a substantially taunt position throughout the process and is advanced from pad bath means 88, where the fluoropolymer is applied to the textile material, through press roll means 89 where excess liquid is removed from the padded textile material. Thereafter, the wet, fluoropolymer treated pH adjusted and backcoated textile material is passed over a plurality of support rollers 91, 92, 93, and 94 and into curing oven 95. The material is advanced through curing oven 95, which is maintained at a temperature sufficient to dry and cure the resulting fluoropolymer modified textile material as same is passed therethrough. The speed at which the textile material is passed through curing oven 95 can vary widely, the only requirement being that the residence time of the material in the oven be sufficient to dry the material and cure the fluoropolymer. From oven 95, the cured and dried fluoropolymer modified textile material 96 is advanced to take up roll 97 which is mounted on a suitable support 98. Take up roll 97 can be a motor driven take up roll to insure advancement of the textile material through each treating step set forth above.

Figure 4:
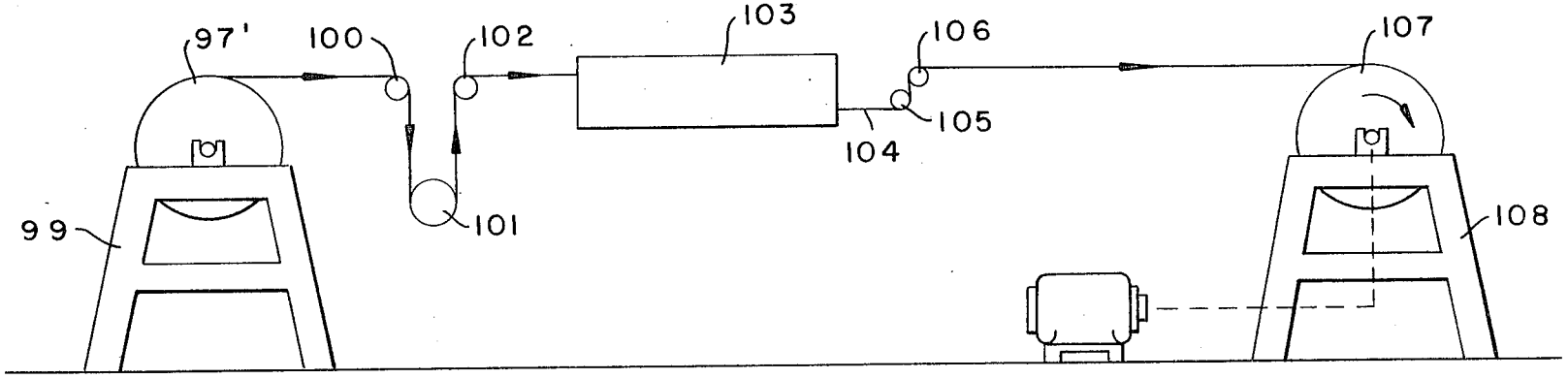
FIG. 4 is a schematic representation of an apparatus which may be employed to shear the face of the fluoropolymer treated textile material prior to dyeing of same.

As in most textile processing operations, the face of the textile material often contains an uneven surface. When such occurs, the fluoropolymer modified textile material 96 on take up roll 97 of FIG. 3 can be moved to a shearing apparatus such as depicted in FIG. 4. Take up roll 97 of FIG. 3 which in FIG. 4 becomes supply roll 97' is mounted on support 99. The fluoropolymer modified textile material is withdrawn from roll 97', advanced over a plurality of rollers, such as rollers 100, 101, and 102 and into shearing means 103. Shearing means 103 can be any suitable shearing apparatus which is well known in the textile art. The sheared fluoropolymer textile material 104 is withdrawn from shearing apparatus means 103 and advanced over a plurality of rollers, such as rollers 105 and 106 to take up roll 107 which is mounted on a suitable support 108. Take up roll 107 may be power driven to insure proper advancement of the material through shearing apparatus means 103. Once the fluoropolymer modified textile material has been sheared, it can be stored for subsequent dyeing or transported immediately to a dyeing apparatus.

Figure 5:
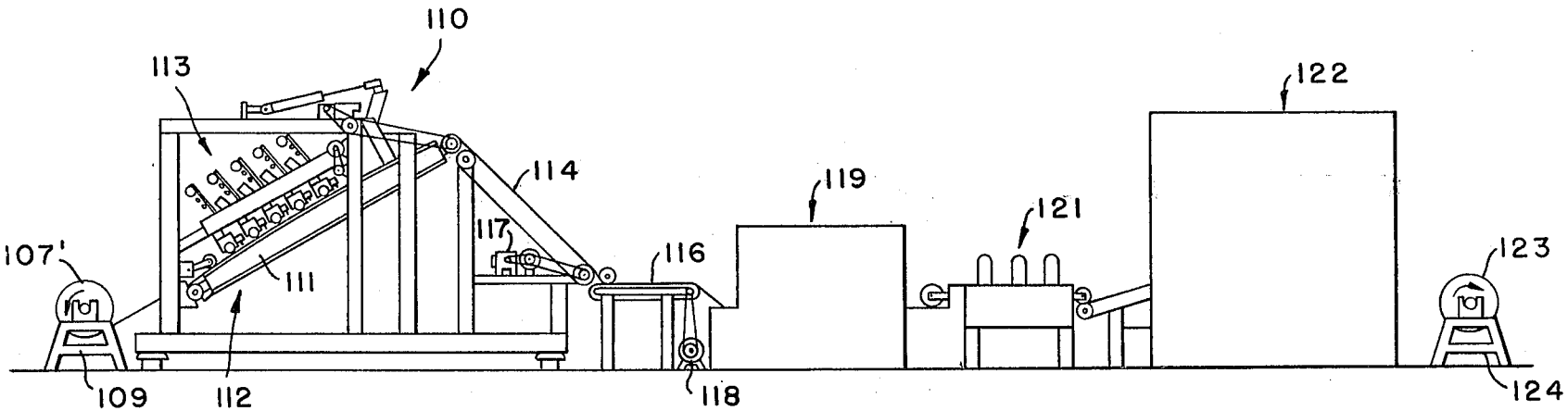
FIG. 5 is a schematic representation of an apparatus for the jet dyeing and printing of fluoropolymer modified closely constructed non-tufted textile materials.

Referring now to FIG. 5, a jet dyeing apparatus is depicted to pattern dry the sheared fluoropolymer modified textile material produced as hereinbefore described. Take up roll 107 of FIG. 4 which now becomes supply roll 107' of FIG. 5 is mounted on a suitable support 109. The fluoropolymer modified textile material is advanced through dyeing apparatus 110 as follows. The textile material is advanced onto the lower end of inclined conveyor 111 of jet applicator section 112, where the fluoropolymer modified textile material is printed by a programmed operation of a plurality of jet gun bars, generally indicated at 113, which inject streams of dye onto the fluoropolymer modified face surface of the textile material during its passage thereunder. The pattern dyed fluoropolymer modified textile material leaving the applicator section is moved by conveyors 114 and 116, driven by motors 117 and 118 to a steam chamber 119 where the textile material is subjected to a steam atmosphere to fix the dyes thereon. The dyed fluoropolymer modified textile material leaving steam chamber 119 is conveyed through a water washer 121 to remove excess unfixed dye from the textile material. Thereafter, the washed textile material is passed through a hot air dryer 122 to take up roll 123 which is mounted on a suitable support 124.

The above sequence of steps and processes set forth schematically illustrate the most desired method for producing the improved products in accordance with the subject invention. In order to more fully illustrate the concept of the subject invention the following examples are given. However, it is to be understood that such examples are not to be construed as unduly limiting the scope of the invention as set forth in the appended claims.

EXAMPLE I

An aqueous solution was prepared containing 15.0 grams per liter (1.5% by weight) of an emulsified, cationic fluorochemical commercially available as FC-234 Scotchgard [R] brand velvet protector, a fluorochemical emulsion manufactured and sold by Minnesota Mining and Manufacturing Co., St. Paul, Minn. FC-234 has the following composition:

30% solid-fluoropolymer
35% methyl isobutyl ketone
8% glycol
35% water the emulsion has a pH of 2.5–3.5, a cationic charge and a density of 1.05 kg/liter. Thus, an aqueous admixture resulted contains about 0.45% fluoropolymer. The mixture was thoroughly agitated to give a homogeneous solution. The above composition was then sprayed onto three samples of a woven nylon upholstery substrate. Wet pickup of spray solution on the fabric and percent fluorocarbon solids applied to the fabric based on dry fabric weight were 126% wet pickup (PU) resulting in 0.56% of the fluoropolymer being applied to the fabric; 54% wet pickup resulting in 0.24% of the fluoropolymer being applied to the fabric, and 31% wet pickup resulting in 0.14% of the polymer being applied to the fabric 0.24% solids; 31% PU, 0.14% solids. Each of the samples were cured at 330° F. for 12.0 minutes. The treated samples were removed from the oven and cooled to room temperature. Each of the three treated samples and one untreated sample (hereinafter called a control) were printed using a jet dyeing apparatus. The samples were evaluated for sharpness of print, frost and dye penetration. In general, the treated samples were sharper than the control exhibiting less frost but had poorer dye penetration. Results are reported in Table I.

TABLE I

| | SPRAY APPLICATION | | | | |
|---|---|---|---|---|---|
| Sample | Fluoro-carbon | % PU | % Polymer on Fabric | Cure Conditions | Appearance |
| I-A | FC-234 15.0g/l | 126 | .56 | 330° F., 10 min. | Low frost, sharp better than cont. |
| I-B | FC-234 15g/l | 54 | .24 | 330° F., 10 min. | As in I-A slightly Decreased Characteristics |
| I-C Control | FC-234 15g/l | 31 | .14 | 330° F., 10 min. | Worse than control Frost and poor pattern definition |

EXAMPLE II

Aqueous solutions, similar to the ones described in Example I, were prepared using 30, 45, 75, and 120 grams per liter of the fluorochemical composition of Example I. Upholstery samples (woven nylon) were padded in the above-described baths at a wet pickup of 87%. The resultant samples, after printing, had good sharpness, good color, low frost and very little bleed. Results and conditions can be found in Table II.

TABLE II

| | PAD APPLICATION | | | | |
|---|---|---|---|---|---|
| Sample | Flu-oro-carbon | % PU | % Fluoro-polymer on Fabric | Cure Conditions | Appearance |
| II-A | 30 g/l | 87 | 0.78 | 330°, 10 min. | All samples had improved print than control. Quality increases with % solids, % PU increase. Padding gives improved side-to-side uniformity |
| II-B | 45 g/l | 87 | 1.173 | 330°, 10 min. | |
| II-C | 75 g/l | 87 | 1.96 | 330°, 10 min. | |
| II-D | 120 g/l | 87 | 3.13 | 330°, 10 min. | |

EXAMPLE III

An aqueous solution was prepared using 40.0 grams/liters of the fluorochemical composition of Example I and 10.1 grams/liters of an emulsifier-extender (CL 100 A, a cationic polyethylene emulsion manufactured and sold by C. S. Tanner). Three samples were sprayed with the treatment at various levels of wet pickup and percent solid fluorocarbon product applied to the fabric. (The conditions and results can be found in Table III). All samples exhibited improved sharpness, less frost and decreased amount of bleed in comparison to a control. However, dye penetrations are decreased in the treated samples.

TABLE III

| | SPRAY APPLICATION | | | | | |
|---|---|---|---|---|---|---|
| Sample | Fluorocarbon | Extender | % PU | % Fluorocarbon on Fabric | Cure Conditions | Appearance |
| III-A | 40 g/l | CL-100A 10g/l | 39 | .468 | 300° F., 10 min. | All samples better than control. Quality improved with increasing % PU and % solids |
| IV-B | 40 g/l | CL-100A 10g/l | 80 | .960 | 300° F., 10 min. | |
| IV-C | 40 g/l | CL-100A 10g/l | 79 | .948 | 300° F., 10 min. | |

EXAMPLE IV

An aqueous solution was prepared using 11.0 grams/liters of the fluorochemical composition of Example I and 0.1 grams/liters of an anionic fluorosurfactant, an anionic ammonium perfluoroalkyl carboxylate fluorosurfactant available as Fluorad FC-143, fluorochemical surfactant manufactured and sold by Minnesota Mining and Manufacturing Co., St. Paul, Minn. This solution was padded onto a sample of woven nylon upholstery fabric. The chemicals were cured to the fibers at 350° F. for 10 minutes, cooled, and dye jet printed. The general results were good dye yield, improved penetration of dyestuffs into the slub yarns, and low degree of bleed and frost. Data and results can be found in Table IV.

TABLE IV

| | (FC-FS) | | | | | |
|---|---|---|---|---|---|---|
| Sample | Fluorocarbon | Fluorosurfactant | % Wet Pickup | % Fluoropolymer and Fluorosurfactant on Fabric | Cure Conditions | Appearance |
| IV-A | 11 g/l | 0.1 g/l | 90 | .30 | 350° F., 10 minutes | Low amounts of frost, low |

TABLE IV-continued

| Sample | Fluorocarbon | Fluorosurfactant | % Wet Pickup | (FC-FS) % Fluoropolymer and Fluorosurfactant on Fabric | Cure Conditions | Appearance |
|---|---|---|---|---|---|---|
| | | | | | | bleed, good sharpness. Improved dye penetration. |

EXAMPLE V

An aqueous solution was prepared using 5.0 grams/liters of a non-ionic fluorosurfactant, a fluorinated alkyl polyoxyethylene ethanol fluorosurfactant available as Fluorad R FC-170 fluorochemical surfactant manufactured and sold by Minnesota Mining and Manufacturing Co., St. Paul, Minn. This solution was applied to a sample of woven nylon upholstery fabric. The treated fabric was cured at 350° F. for 10 minutes, cooled and dye jet printed. The resultant sample was of very poor quality and would be considered unacceptable. See Table V for results.

TABLE V

| Sample | Fluorocarbon | FLUOROSURFACTANT Fluorosurfactant | % Wet Pickup | % Fluorosurfactant on Fabric | Cure Conditions | Appearance |
|---|---|---|---|---|---|---|
| V-A | None | FC-170 non-ionic | 90 | .45 | 330° F., 10 minutes | Very poor, unacceptable |

EXAMPLE VI

An aqueous mixture was made up containing 5.0 gram/liter of an aqueous fluorochemical (FC-234). The solution was thoroughly mixed and said mix was applied by spray to a sample of woven nylon upholstery fabric. The percent wet pickup was 33.7% with the percent solids (fluorocarbon) applied to the fabric (based on dry fabric weight) being 0.050%. The treated sample was cured at 350° F. for 5.0 minutes. The resultant jet dyed print was of poor quality having poor sharpness and a large amount of frost. This sample was inferior to a control (untreated) sample in all respects.

EXAMPLE VII

Aqueous mixtures were prepared containing various, non-fluorine containing surface active agents. (See Table VII for chemicals and data.) Each of the samples were dried or cured according to the suppliers suggestions. The resultant modified textile material was then dyed by a jet dyeing process. None of the treated samples exhibited any satisfactory print results. All exhibited excessive amounts of frost, poor color and pattern definition.

TABLE VII

| Chemical | % Solids | % Bath Concentration | % of Material on Textile Materials | % Wet Pickup |
|---|---|---|---|---|
| Cationic[1] | | | | |

TABLE VII-continued

| Chemical | % Solids | % Bath Concentration | % of Material on Textile Materials | % Wet Pickup |
|---|---|---|---|---|
| Polyethylene Anionic[2] | 30 | | 1.0 | 95 |
| Surfactant Non-ionic[3] | 30 | | 1.0 | 82 |
| Surfactant Extender[4] | 100 | | 1.0 | 125 |
| Wax-Resin Resin[5] | 26 | 2.2 | 0.6 | 104 |
| Extender | 25 | 2.5 | 0.5 | 90 |
| Wax Resin[6] | 20 | 3.1 | 0.5 | 85 |
| Silicon[7] Emulsion | 30 | 1.85 | 0.5 | 80 |
| Ethylene[8] Copolymer | 12 | 5.21 | 0.5 | |

Each of the chemicals set forth are commercially available non-fluorine containing surface active agents and are manufactured and sold under the following manufacturers:

[1]CL-11 - manufactured by C. S. Tanner
[2]SS-99 - manufactured by DuPont
[3]CO-530 - manufactured by GHF
[4]Norane 193 - manufactured by Sun Chemical
[5]Nolan W - manufactured by DuPont
[6]Eccopel LB - manufactured by Eastern Color
[7]Aquagard 170 - manufactured by Solvol Chemical
[8]Malic - manufactured by Lotex Co.

EXAMPLE VIII

Production grade fabric is processed by the following general sequence: backcoating, scour, fluorocarbon treatment, shear and jet dye. Backcoating is done by passing the fabric, from a feed roll over numerous guide rolls through a knife-over-roll backcoater. The premixed backcoating fluid is applied from a pickup roll and leveled to the desired thickness (4 oz/yd$^2$) by use of a doctor blade. The coated fabric is passed through a horizontal oven at 18 yards per minute. The time in the oven (375° F., 4 zones; 350° F., 6 zones) is 1.85 minutes. The exiting fabric is collected on an uptake roll. The fabric is then transferred for scouring.

Scouring takes place by passing the backcoated fabric through 4 dip tanks. The first tank in the series contains an industrial detergent (1-dodecanol ethoxylate 0.50%) to remove any dirt or residual processing aids on the fibers. The fabric is passed through a second and third bath containing $H_2O$ for rinsing. The fourth processing bath contains an acidic solution at a pH of 3.5 (acetic acid). The resultant fabric, having a pH of 4.5, is passed through a horizontal dryer maintained at about 335° F. for 3.85 minutes at a speed of 26 feet per minute. Fabric is collected on an uptake roll.

Fluorocarbon treating is done by passing the scoured, pH adjusted fabric through a series of guide rolls into a dip tank containing the fluoropolymer in an aqueous solution (1.2% FC-234). Wet pickup of liquid on the fabric is controlled by means of press rolls. The wet pickup is controlled at 90.5%. The wet fabric is passed through a horizontal oven at 18 yards per minute for 1.85 minutes. The temperature is maintained at 350° F. The dried, cured fabric is collected on an uptake roll.

The resultant polymer modified upholstery fabric is prepared for jet injection dyeing by shearing. The fabric is sheared by passing it through a tip shearing, single blade shear. The resultant fibers are 1/32" higher than slub yarns in length.

The backcoated, scoured, fluoropolymer modified, sheared fabric is pattern dyed by jet dyeing techniques. The resultant fabric is steamed, washed, dried and passed onto inspection.

EXAMPLE IX

A knitted upholstery fabric consisting of 100% acrylic face and 100% polyester ground yarn was backcoated with a foamed acrylic adhesive, same acrylic formulation as previously set forth except with no $TiO_2$ present (water higher) and the face of the fabric was simultaneously treated with an aqueous admixture containing 22 grams/liters (2.2% by weight) of an emulsified, cationic fluorochemical emulsion manufactured and sold by Minnesota Mining and Manufacturing Co., St. Paul, Minn. and 8 grams/liters of an emulsifier-extender (CL 100A, a cationic polyethylene emulsion manufactured and sold by C. S. Tanner). FC-234 has the following composition:

30% solids-fluoropolymer
35% methyl isobutyl ketone
8% glycol
35% water.

The thus treated fabric was then dried and cured at 300° F.–350° F. for about 80 seconds. The cured, backcoated, polymer-modified fabric was then brushed, transfer printed, and rebrushed. Upon examination, it was noticed that clarity of print and color definition was improved over samples of the material without the fluoropolymer.

Having thus described the invention I claim:

1. In a process for improving the sharpness of a pattern of dye applied to closely constructed non-tufted textile materials characterized as having a weight of at least about 4 ounces per square yard with a jet dyeing apparatus including conveying means for transporting the textile, jet orifices for delivering dye in a pattern to said textile material and control means for supplying data to control the operation of the application of dye from the jet orifices to the textile material, said process including the sequential steps of modifying the textile material prior to dyeing of same with the jet dyeing apparatus by applying an aqueous admixture containing an effective minor amount of a substantially oil and water repellent fluoropolymer to the textile material to provide from about 0.20 to about 2.5 weight percent of the fluoropolymer on the textile material, heating the fluoropolymer treated textile material to a temperature effective to dry the textile material and cure the fluoropolymer thereby providing a fluoropolymer modified textile material, dyeing the fluoropolymer textile material, and recovering a resulting dyed fluoropolymer modified textile material, the improvement comprising incorporating into the aqueous admixture containing the fluoropolymer from about 0.001 to about 0.01 weight percent of a fluorosurfactant, said fluorosurfactant containing a $F_3CCF_2CH$— moiety.

2. The product produced by the process of claim 1.

3. The process as defined in claim 1 wherein said aqueous admixture further includes from about 5 to about 30 weight percent of an organic carrier selected from the group consisting of methyl isobutyl ketone and methyl ethyl ketone and from 0 to about 15 weight percent of a stabilizer from the group consisting of glycol and ethylene glycol.

4. The process as defined in claim 1 wherein said fluorosurfactant is an anionic or nonionic fluorosurfactant.

5. The process as defined in claim 4 wherein said fluorosurfactant is an anionic fluorosurfactant selected from the group consisting of ammonia perfluoroalkyl sulfonates, potassium perfluoroalkyl sulfonates and potassium perfluorocarboxylates.

6. The process as defined in claim 4 wherein said fluorosurfactant is a nonionic fluorosurfactant selected from the group consisting of fluorinated alkyl polyoxyethylene ethanol acid fluorinated alkyl esters.

7. The process as defined in claim 4 wherein said aqueous admixture of said fluoropolymer and said fluorosurfactant is applied to the textile material by padding said aqueous admixture onto the textile material.

8. The product produced by the process as defined in claim 7.

9. In a process for improving the sharpness of a pattern of dye applied to closely constructed non-tufted textile materials which includes applying from about 0.20 to about 2.5 weight percent of substantially oil and water repellent fluoropolymer to the textile material to provide a polymer modified textile material, heating the polymeric modified textile material at a temperature effective to cure said polymeric constituent, and applying dye in a pattern to the cured polymeric modified textile material; the improvement comprising applying from about 0.001 to about 0.01 weight percent of fluorosurfactant in combination with said fluoropolymer.

10. The process as defined in of claim 9 wherein said fluorosurfactant and fluoropolymer are present in an aqueous admixture and said aqueous admixture further includes from about 5 to about 30 weight percent of an organic carrier selected from the group consisting of methyl isobutyl ketone and methyl ethyl ketone and from 0 to about 15 weight percent of a stabilizer from the group consisting of glycol and ethylene glycol and said fluorosurfactant is an anionic or nonionic fluorosurfactant and contains an $F_3CCF_2CH$— moiety.

11. The process as defined in claim 10, said fluorosurfactant is an anionic fluorosurfactant selected from the group consisting of ammonia perfluoroalkyl sulfonates, potassium perfluoroalkyl sulfonates and potassium perfluorocarboxylates.

12. The process as defined in claim 10 wherein said fluorosurfactant is a nonanionic fluorosurfactant selected from the group consisting of fluorinated alkyl polyoxyethylene ethanol acid fluorinated alkyl esters.

* * * * *

UNITED STATES PATENT OFFICE

CERTIFICATE OF CORRECTION

Patent No. 4,231,744 Dated November 4, 1980

Inventor(s) Lorence M. Moot

It is certified that error appears in the above-identified patent and that said Letters Patent are hereby corrected as shown below:

Column 2, line 44, after the word "herein" insert --is--.

Column 8, line 48, the word "and" should be --any--.

Column 20, line 43, delete the word "of".

Signed and Sealed this

Third Day of March 1981

[SEAL]

Attest:

RENE D. TEGTMEYER

Attesting Officer

Acting Commissioner of Patents and Trademarks